US010246172B2

(12) United States Patent
Arendts

(10) Patent No.: US 10,246,172 B2
(45) Date of Patent: Apr. 2, 2019

(54) DEPLOYABLE SHELL REVERSIBLE CAMBER SAIL SYSTEM

(71) Applicant: James G. Arendts, Thayne, WY (US)

(72) Inventor: James G. Arendts, Thayne, WY (US)

( * ) Notice: Subject to any disclaimer, the term of this patent is extended or adjusted under 35 U.S.C. 154(b) by 0 days.

(21) Appl. No.: 15/192,658

(22) Filed: Jun. 24, 2016

(65) Prior Publication Data

US 2017/0369139 A1 Dec. 28, 2017

(51) Int. Cl.

| | |
|---|---|
| ***B63H 9/06*** | (2006.01) |
| ***B63H 9/10*** | (2006.01) |
| ***B63B 15/00*** | (2006.01) |
| ***B63B 15/02*** | (2006.01) |

(52) U.S. Cl.

CPC ..... *B63H 9/0657* (2013.01); *B63B 15/0083* (2013.01); *B63B 15/02* (2013.01); *B63H 9/0607* (2013.01); *B63H 9/1035* (2013.01); *B63H 9/1092* (2013.01); *B63B 2015/0016* (2013.01)

(58) Field of Classification Search

CPC ... B63H 9/0657; B63H 9/1092; B63H 9/0607
See application file for complete search history.

(56) References Cited

U.S. PATENT DOCUMENTS 3,332,383 A * 7/1967 Wright ..... B63H 9/0607 114/102.16
3,934,533 A * 1/1976 Wainwright ..... B63H 9/0607 114/102.16
4,064,821 A * 12/1977 Roberts, Jr. ..... B63H 9/0607 114/102.26
4,388,888 A * 6/1983 Gushurst, Jr. ..... B63H 9/0607 114/102.32
4,561,374 A * 12/1985 Asker ..... B63H 9/0607 114/102.17
4,625,671 A * 12/1986 Nishimura ..... B63B 35/7936 114/102.25
4,686,921 A * 8/1987 Magnan ..... B63B 35/7973 114/102.25
4,708,079 A * 11/1987 Magnan ..... B63B 35/7973 114/102.25
4,848,258 A * 7/1989 Priebe ..... B63H 9/0607 114/102.22
6,141,809 A * 11/2000 Lyngholm ..... B63H 9/1035 114/102.22
6,431,100 B2 * 8/2002 Abshier ..... B63H 9/1021 114/102.1
7,114,456 B2 * 10/2006 Sohy ..... B63H 9/0607 114/102.22
9,422,043 B2 * 8/2016 Englebert ..... B63H 9/0607

* cited by examiner

*Primary Examiner* — Anthony D Wiest

(57) ABSTRACT

One embodiment of a deployable reversible camber sail system, based on a deployable shell (58) contained within a mast-sail assembly (11, 12) and supported and controlled by additional assemblies (13-15), is disclosed. The embodiment may be easily and quickly configured into the furled, feathered, port tack and starboard tack sail forms. In addition, this embodiment represents a highly efficient sail module which may be controlled by a single human operator or automated computer-based control system. Additional embodiments, utilizing assemblages of the first embodiment sail system module, are described.

9 Claims, 14 Drawing Sheets

DEPLOYABLE SHELL REVERSIBLE CAMBER SAIL SYSTEM

CROSS-REFERENCE TO RELATED APPLICATIONS

This application uses the deployable sandwich-like shell disclosed in my U.S. patent application Ser. No. 15/131,983, filed 2016 Apr. 18, which is incorporated by reference.

PRIOR ART—REFERENCES

The following is a tabulation of some prior art that presently appears relevant:

| Pat. No. | Kind Code | Issue Date | Patentee |
|---|---|---|---|
| 3,332,383 | | 1967-07-35 | Wright |
| 3,934,533 | | 1976 Jan. 27 | Wainwright |
| 4,064,821 | | 1977 Dec. 27 | Roberts, Jr. et al. |
| 4,561,374 | | 1985 Dec. 31 | Asker |
| 4,625,671 | | 1986 Dec. 2 | Nishimura |
| 4,848,258 | | 1989 Jul. 18 | Priebe |
| 6,141,809 | | 2000 Nov. 7 | Lyngholm |
| 6,431,100 | B2 | 2002 Aug. 13 | Abisher |
| 7,114,456 | B1 | 2006 Oct. 3 | Sohy |

U.S. PATENT APPLICATION PUBLICATIONS

| Publication Nr. | Kind Code | Pub. Date | Applicant |
|---|---|---|---|
| 20150033998 | A1 | 2015 Feb. 5 | Englebert et al. |

PRIOR ART—DISCUSSION

Wind sail technology has been in development for thousands of years. Thus, the present discussion must be limited to those developments in sail technology represented by relatively recent patent records. Conventional sails which are attached to a spar or standing rigging, constructed of fabric, and associated fittings and lines are not discussed. Also, rigid or nearly rigid single sails, as well as Magnus effect devices are not discussed.

Four major themes are discussed: (a) efficiency—relative ability of sail to derive driving force from a given relative wind velocity, (b) economy—simplicity and cost effectiveness of the sail design, (c) safety—ability of sail to be quickly furled or stowed before or during dangerous wind conditions and (d) operability—degree to which sail configuration changes may be automated and human interaction minimized.

During the past 150 years, commercial sail operations have effectively ceased. A sail design that scores highly in the above four categories would allow shippers to rebuild pure sail or sail augmented profitable commercial operations. In addition, competitive and purely recreational sailing would benefit from such a sail design.

(a1) Relative wind velocity (direction and strength) greatly effect sail efficiency. If the relative wind direction is from a direction "abaft the beam" (generally from the rear to front of the ship), any design that generates a large drag force, such as the "square rigger" sail is efficient. As true wind direction becomes more "abeam" (normal to ship fore-aft axis), relative wind direction shifts to a more forward direction where the shape of the sail horizontal cross-section becomes important. All of the patent and patent application references cited above disclose sail designs that have a more-or-less "airfoil" horizontal cross-sectional shape. In this context, an airfoil shape is that of a typical low-speed airplane wing cross-section. For wind speeds encountered for normal sailing conditions, the low-speed airfoil shape is efficient in that it generates large lift and low drag aerodynamic forces for normal angles of attack (angle of relative wind in relation to the luff-leech axis of the sail). Angle of attack is adjusted (sail rotated with respect to the relative wind) so that the resultant lift-drag vector is maximized for the ship's course direction.

(a2) U.S. patent application 20150033998 discloses a rigid airfoil shaped sail which is hinged to allow entry to shipping ports. In this design, the sail cross-section is symmetrical—the wing cross-section has no camber resulting in decreased efficiency for either starboard or port tacks (relative wind direction from either the right or left, respectively, for an observer looking forward). In addition, U.S. Pat. No. 6,431,100 discloses a semi-rigid symmetrical camber-less sail design. Airfoils with reversible camber designs are important so that they are equally efficient for both relative wind tack directions. The remainder of the cited references disclose reversible camber airfoil designs. These designs range from complicated (several interconnecting rigid panels, U.S. Pat. No. 3,934,533) to relatively simple (fabric skins with collapsible rigid internal stiffeners, U.S. Pat. No. 7,114,456). U.S. Pat. No. 4,625,671 discloses a simply constructed reversible camber airfoil design reminiscent of the (not very efficient) "Wright flyer" wing profile.

(b1) Economical evaluation of sail design prior art is subjective. Two measures are design simplicity and ease of manufacture of the sail. Four of the cited patents are based on revisions of conventional sail design. The previously mentioned U.S. Pat. No. 4,625,671 discloses a relatively conventional fabric sail design containing only a few additional elements required for the airfoil shape of the sail cross-section. Three U.S. patents disclose designs of double-walled fabric with differing means of varying the cross-section shape. U.S. Pat. No. 6,141,809 utilizes induced air pressure for inflation and variation of the sail shape. Previously cited U.S. Pat. No. 7,114,456 utilizes hinged collapsible internal rigid stiffeners for maintenance of cross-section shape. U.S. Pat. No. 4,064,821 utilizes mechanically connected internal spars whose lateral displacements induce sail shape change.

(b2) More complex fabric based designs are disclosed in U.S. Pat. Nos. 6,431,100 and 4,848,258. The former utilizes a single large fabric sail with batten-like internal semi-rigid inserts for maintenance of non-variable sail cross-section shape. The second of these designs uses several fabric double-walled sail elements containing internal rigid stiffeners. Each of these sail elements may be independently rotated about vertical axes for formation of variable shaping of the overall system. Included in this group is U.S. Pat. No. 3,332,383 disclosing an airfoil design based on a flexible skin with very complex internal mechanism for reversing the cross-section camber.

(b3) U.S. Pat. Nos. 3,934,533 and 4,561,374 and U.S. patent application 20150033998 disclose sail designs that are comprised entirely of rigid elements. The first of these designs consist of two large rigid panels mounted to a common mast. The panels may be rotated relative to each other about the mast thus forming reversing camber airfoil-like cross-sections. The second patent listed discloses a three rigid panel design, of which the central panel assumes the mast function and may be rotated relative to the ship. The remaining two rigid panels are each hinged to the mast panel, the rotation of which forms various overall assembly cross-sectional shapes. The patent application discloses a very large essentially rigid symmetric airfoil sail design which rotates with an integral mast. Wing flap-like panels are hinged to the trailing edge of the main airfoil to provide additional lift force for both tack directions. The overall sail is hinged about the horizontal axis so that the upper part of the sail can be lowered to a horizontal position enabling the ship to pass under bridges and dock structures.

(c1) The ability to quickly furl, retract or collapse a sail before or during dangerous wind conditions is very important for overall safety of the sail design. All of the fabric based sail designs are capable of being vertically collapsed. However, the process of collapsing the sail and securing or stowing it could be a lengthy and labor intensive process.

(c2) The remainder of the sail designs discussed contain no provisions for furling, retraction, or stowage of the sail. In an emergency all of them could be feathered (set in a minimum aerodynamic drag configuration) and allowed to "windmill" or self seek the lowest drag force condition. Dangerous forces could still be generated for hurricane winds. However, the large sail disclosed in patent application 20150033998 could generate dangerous forces when in a feathered state for moderately strong winds. Even if the upper portion of this sail were lowered to a horizontal position, potentially dangerous forces could be generated for all strong winds.

(d1) None of the reviewed designs emphasize ease of operation or potential for automation. Two designs did indicate means of powering mast rotations. No designs provided for means of automating sail configuration changes.

(d2) Utilization of any of the reviewed sail designs for commercial purposes would require a significant amount of human labor, potentially offsetting the economic advantages of using commercial sail power. In addition to economics, use of commercial sail power could significantly reduce diesel exhaust pollution, marine environment acoustic pollution (shown to be detrimental to some sea life) and fuel bunker purge-leakage pollution.

SUMMARY

A new sail design is disclosed which is based on the cross-referenced U.S. patent application for a deployable sandwich-like shell. The overall sail module is comprised of three assemblies: 1. a central mast-sail assembly, 2. a lower control and guide assembly, 3. an upper control and guide assembly (mirror image of the lower assembly). A fourth assembly is: 4. the sail module support and rotation assembly. The central assembly consists, in part, of three concentric cylinders: the mast, upper and lower control assembly connection tube, and a mandrel upon which the un-deployed sail is connected and furled. The central assembly consists, additionally, of moveable aerodynamic fairings and sheets. The control assemblies contain the means for independently rotating the sail storage mandrel and aerodynamic fairings. These assemblies also contain moveable deployed sail guide tracks. Finally, the sail module support and rotation assembly supports the mast and contains means for powering overall sail module rotation.

Advantages

The deployable shell reversible camber sail system design disclosed herein scores very high in the four general categories discusses above and is, in general, uniquely superior to all of the reviewed sail designs for the following combined reasons:

(a) Deployed sail cross-sections for port and starboard tack configurations, as well as the feathered state, are aerodynamically efficient having high lift (for the asymmetrical configurations) and low drag forces, (b) The design may be easily constructed of inexpensive light weight metal alloys and/or fiber reinforced polymer materials, (c) For unfavorable relative wind conditions, the sail may be easily configured to the low-drag feathered state, and for dangerous wind conditions, the sail may be automatically and quickly stowed into the furled state resulting in very high operational safety, (d) All of the sail configuration change operations, as well as overall sail angle of attack adjustments, utilize individual means of force application which may be controlled by a single human operator or computer, (e) Due to the inherent modularity of the design, two or more sail modules may be connected so as to form a larger combined sail which may be used for recreational high performance, competition, or commercial uses.

DRAWINGS—FIGURES

In the drawings, closely related figures have the same number but differing alphabetical suffixes.

FIGS. 6A through 6G illustrate a typical control and guide assembly: overall side view, plan view, plan detail 1, cross-section detail 1, plan detail 2, cross-section detail 2, mandrel base—cam plate detail.

Figure 7A:
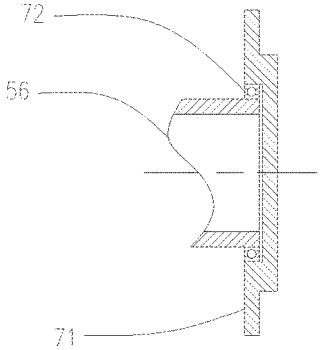
Figure 7B:
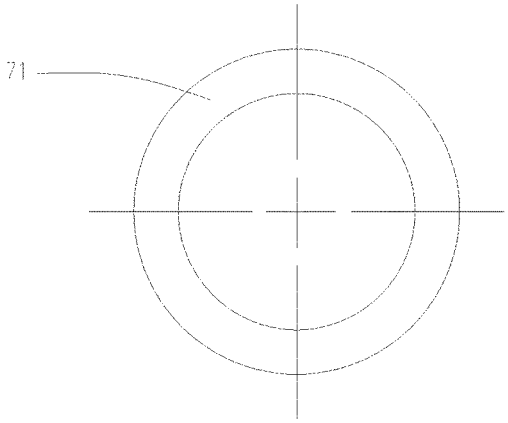

FIGS. 7A and 7B are cross-section and plan views of the upper control and guide assembly cover for use in free-standing sail module applications.

Figure 8A:
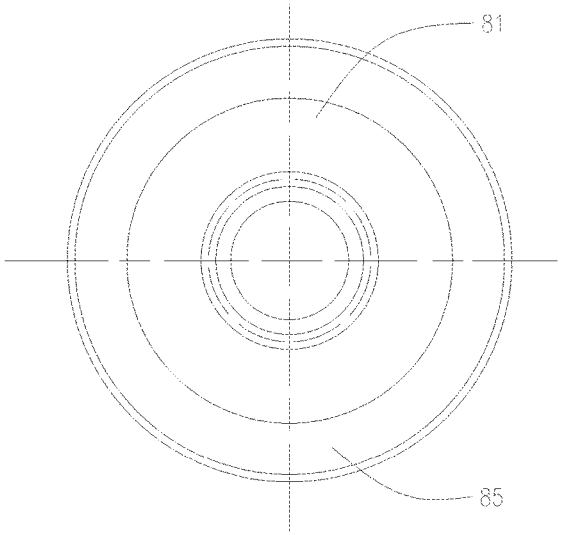
Figure 8B:
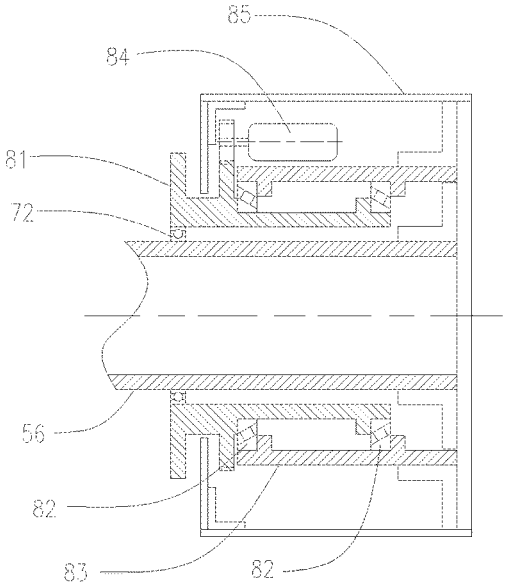

FIGS. 8A and 8B are sail module support and rotation assembly plan and cross-section views.

Figure 9A:
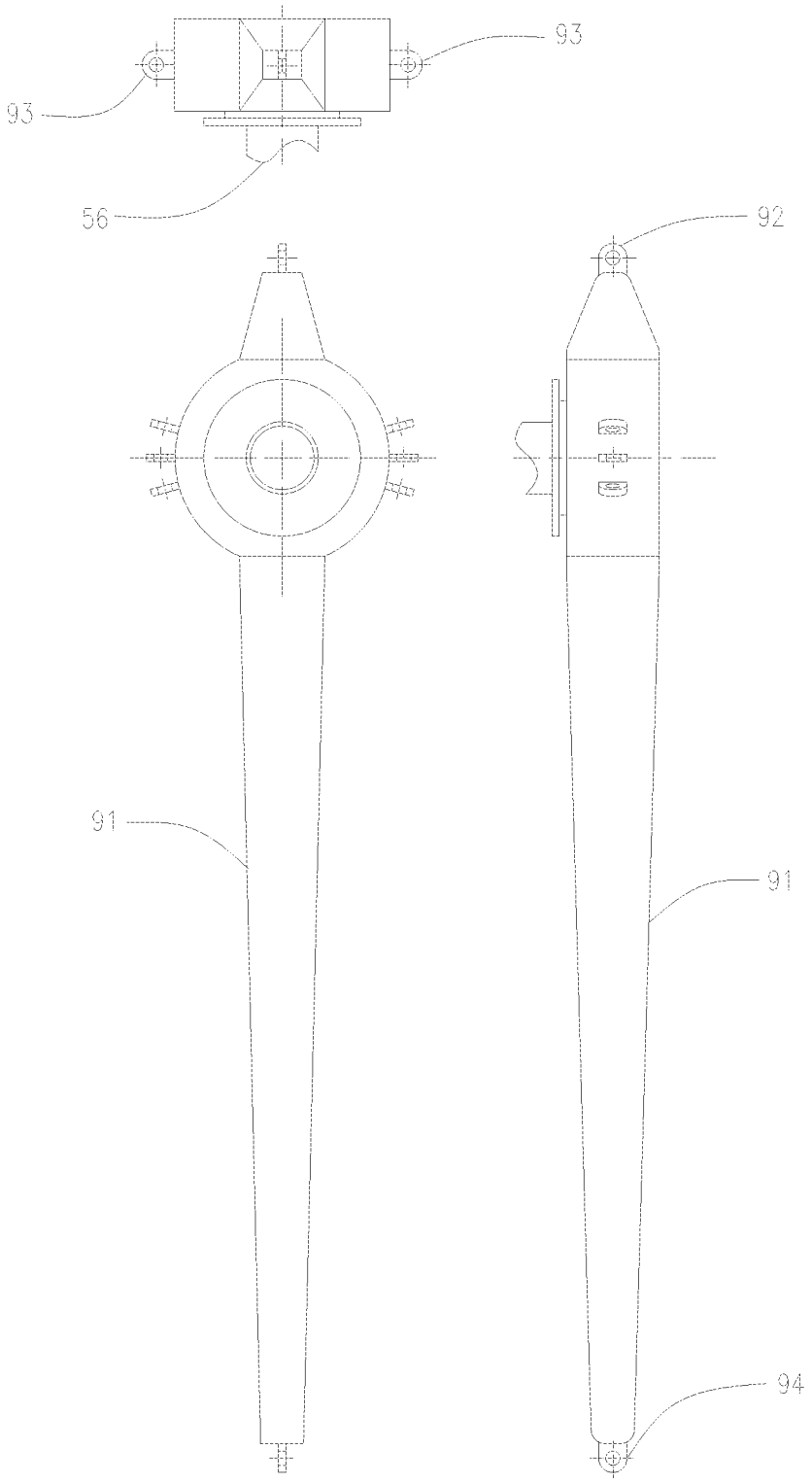
Figure 9B:
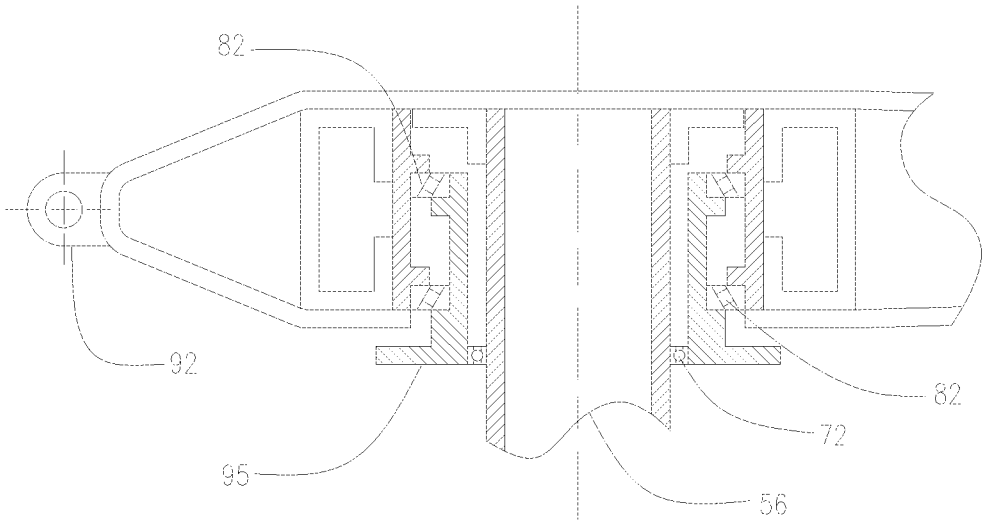
Figure 9C:
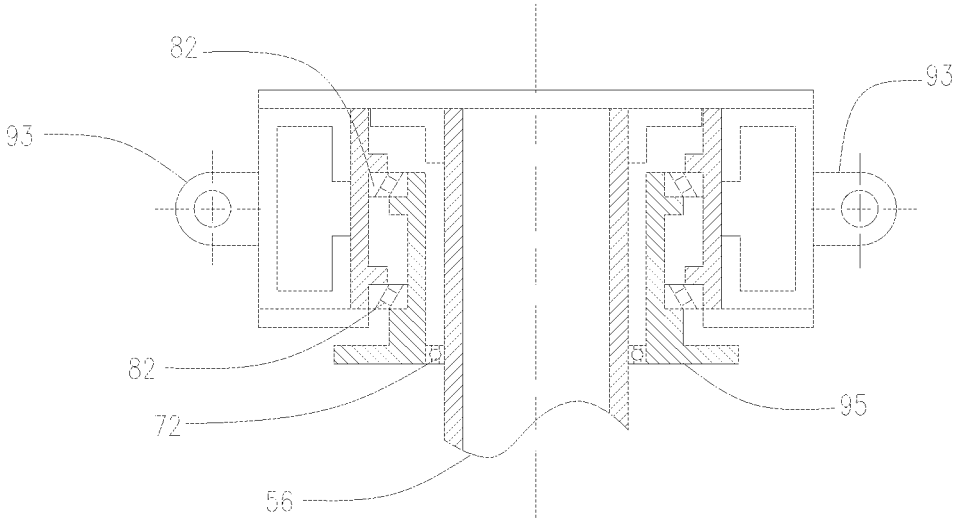

FIGS. 9A through 9C show, for use with standing rigging applications, the additional embodiment mast head assembly overall views, and cross-section details.

Figure 10:
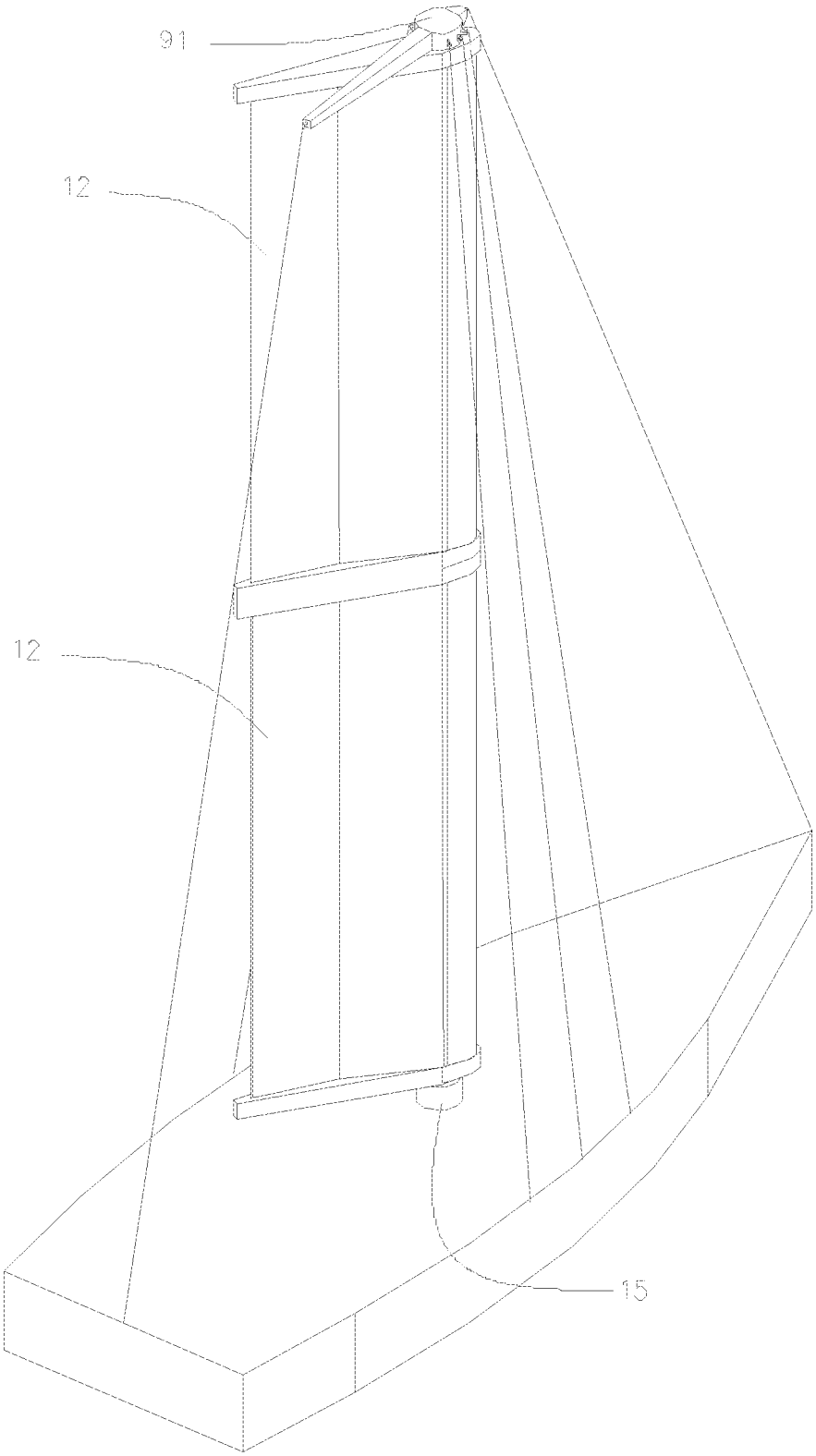

FIG. 10 illustrates a conceptual high performance yacht additional embodiment.

Figure 11:
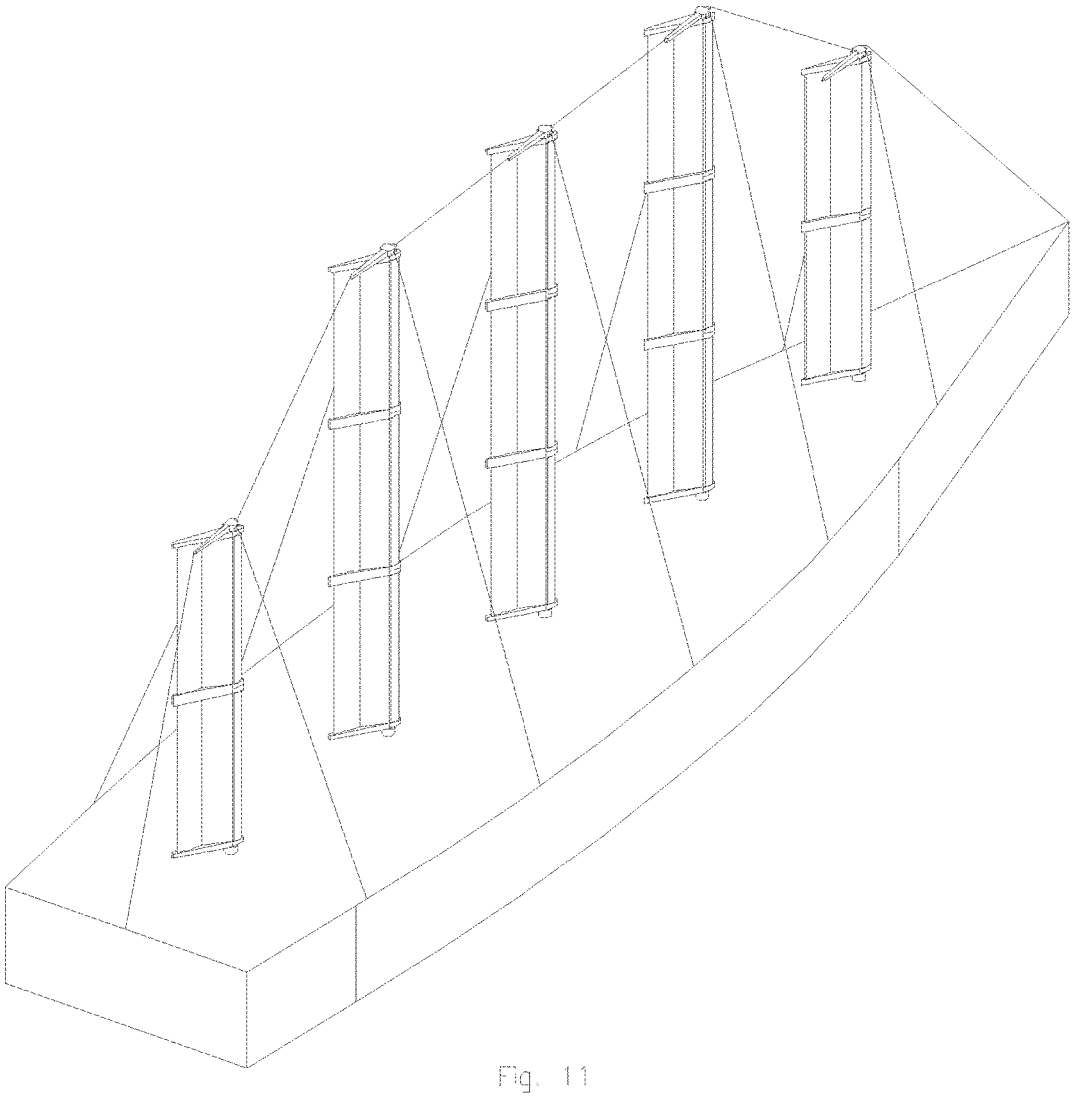

FIG. 11 shows a conceptual purpose-built commercial sailing vessel additional embodiment.

Figure 12:
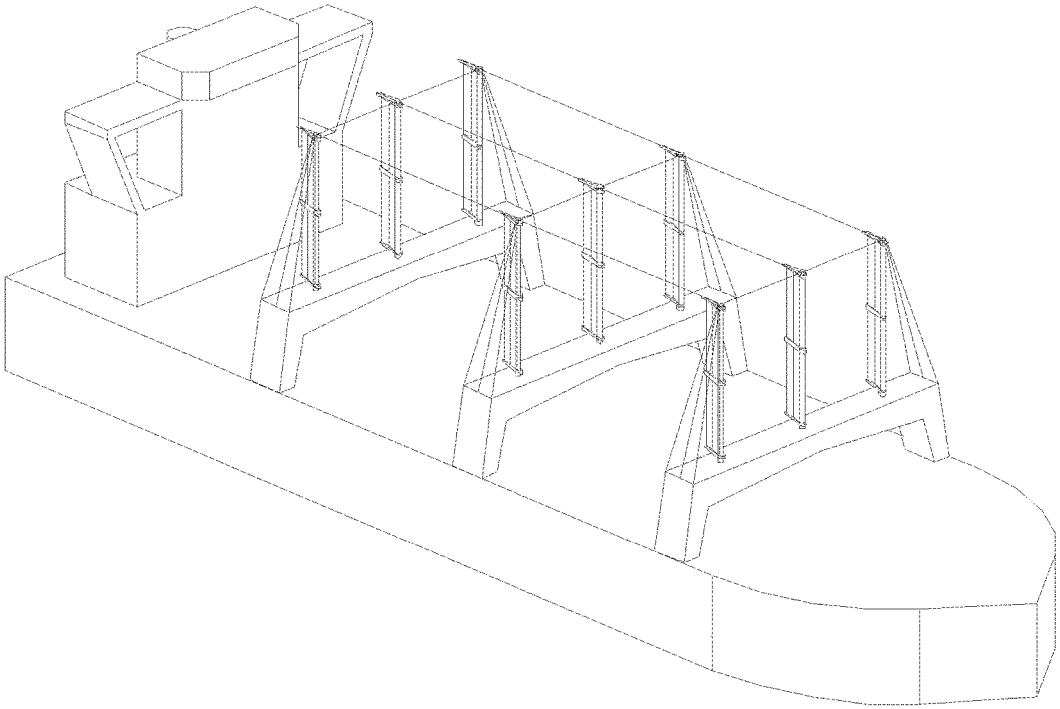

FIG. 12 illustrates a conceptual sail-augmented commercial transport vessel additional embodiment.

| Drawings - Reference Numerals | |
|---|---|
| 11 furled mast-sail assembly | 12 deployed mast-sail assembly |
| 13 upper control and guide assembly | 14 lower control and guide assembly |

-continued

| Drawings - Reference Numerals | |
|---|---|
| 15 sale module support and rotation assembly | 21 true wind direction |
| 31 outer panel | 32 inner panel |
| 33 typical web element | 34 typical web support location |
| 35 typical web-to-panel hinge | 36 mandrel |
| 37 mandrel-to-sail connection device | 41 web support and guide |
| 51 outer aerodynamic fairing | 52 inner fairing |
| 53 fairing sheet take-up roll | 54 sail compression roller |
| 55 flexible fairing sheet | 56 mast |
| 57 control and guide connection tube | 58 deployed sail |
| 59 airfoil chord | 61 control and guide assembly housing |
| 62 sail support and guide track | 63 track - cam connection pin |
| 64 sail module connection flange | 65 fairing support ring |
| 66 cam plate | 67 fairing rotation torque motor |
| 68 cam plate torque motor | 69 guide track rotation center pin |
| 71 mast top cover | 72 mast alignment ball bearing |
| 81 sail module support flange | 82 tapered roller bearing |
| 83 outer support tube | 84 sail module rotation torque motor |
| 85 mast step - module rotation housing | 91 mast head assembly housing |
| 92 forestay attachment fitting | 93 shroud attachment fitting |
| 94 backstay attachment fitting | 95 sail module connection flange |

EMBODIMENT DETAILED DESCRIPTIONS

First Embodiment—FIGS. 1A through 2D

FIGS. 1A through 1D illustrate, respectively, four views of this embodiment: the sail system in the furled configuration, port tack, feathered and starboard tack configuration. As shown in the figures, this sail system embodiment is composed of four assemblies: the mast-sail assembly 11 and 12, the upper control and guide assembly 13, lower control and guide assembly 14, and the sail module support and rotation assembly 15. Detailed descriptions of these assemblies are given in the following paragraphs.

Figure 1A:
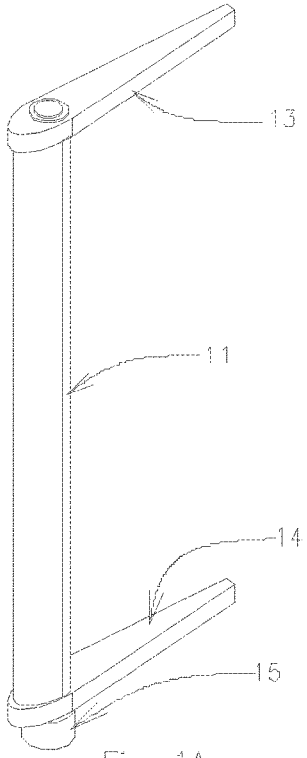
FIGS. 1A through 1D illustrate the first embodiment basic assemblies of the sail system in furled, port tack, feathered and starboard tack configurations, respectively.
Figure 1B:
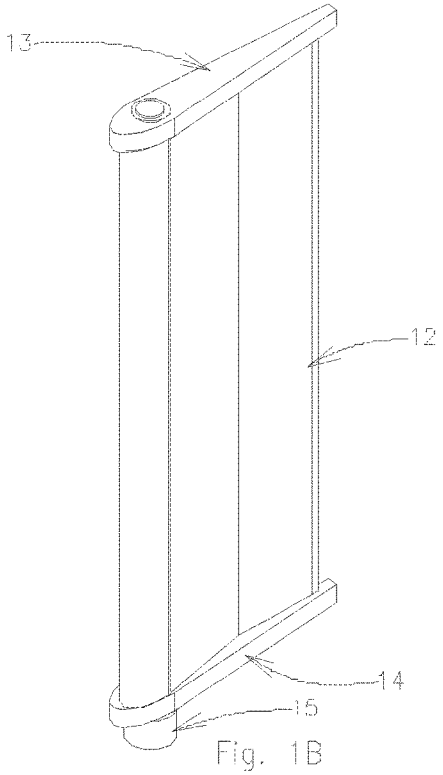
Figure 1C:
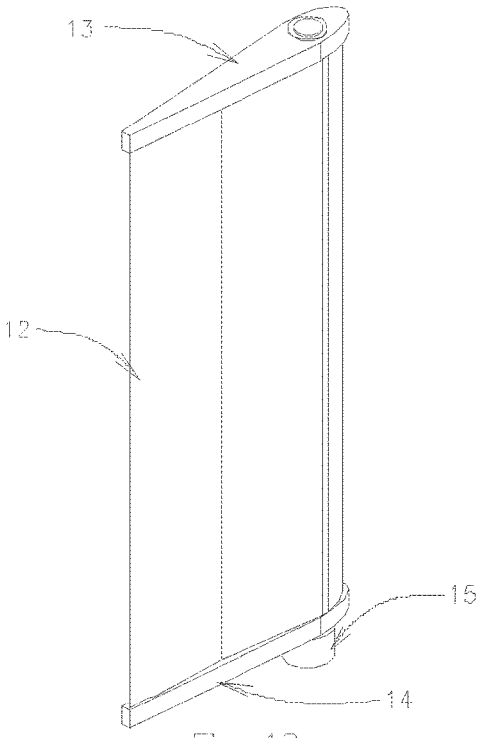
Figure 1D:
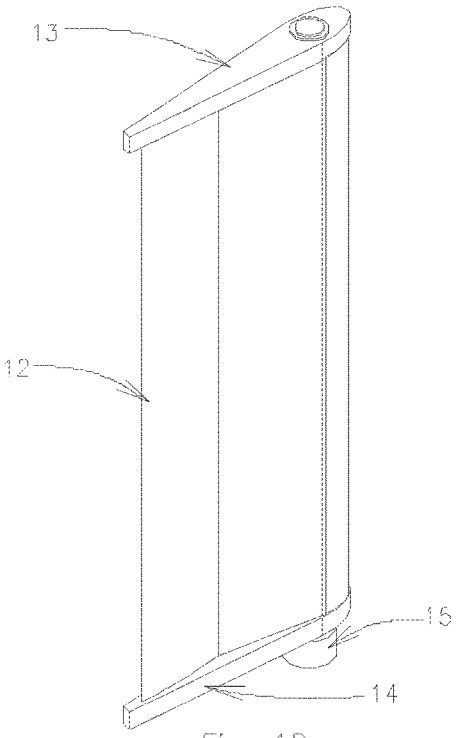
Figure 2A:
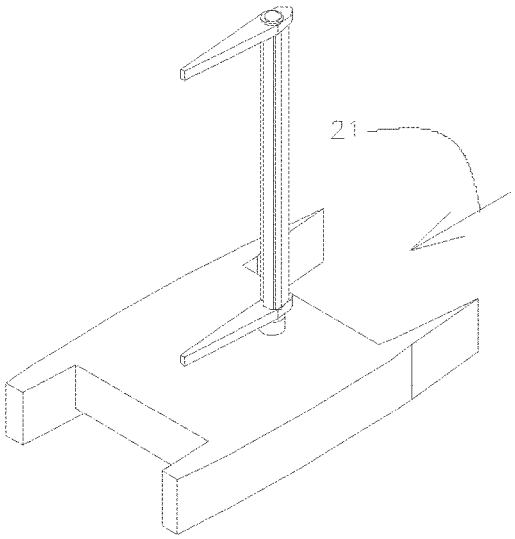
FIGS. 2A through 2D illustrate the first embodiment sail system configurations for typical sailing conditions: furled, starboard tack, feathered and port tack, respectively.
Figure 2B:
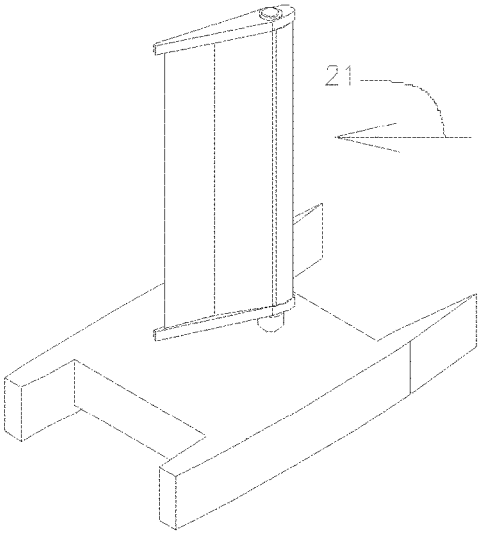
Figure 2C:
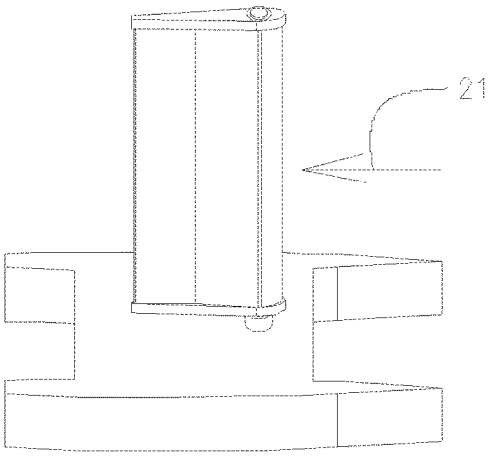
Figure 2D:
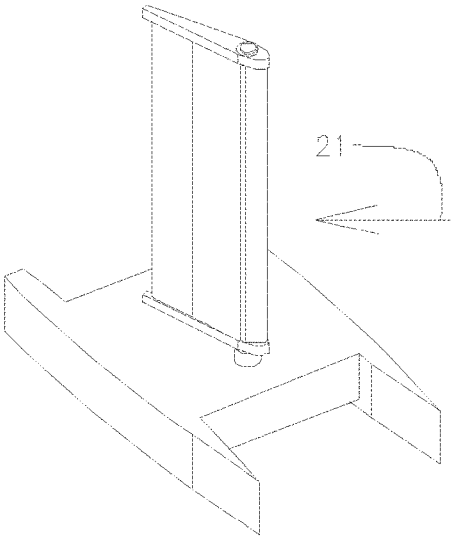

Actual usage of the sail system embodiment is symbolically shown in FIGS. 2A through 2D for various sailing conditions where the large arrow 21 indicates the direction of the true wind. The initial sail system furled condition is shown in FIG. 2A. FIG. 2B illustrates use of the system for a starboard tack wind. During a tacking maneuver, a feathered sail system configuration may be employed, as shown in FIG. 2C. Following completion of the tacking maneuver, the port tack configuration is shown in FIG. 2D. All of the sail system configuration changes shown in these figures are performed using motors contained in the individual assemblies. These motors may be controlled manually or by a computerized control system

First Embodiment, Mast-Sail Assembly—FIGS. 3A through 5D

Figure 3A:
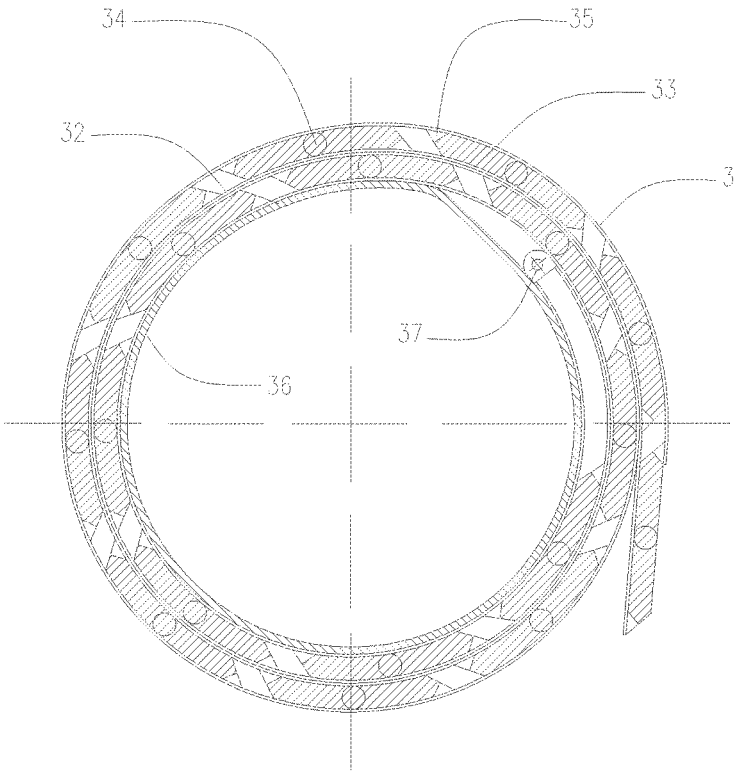
FIGS. 3A and 3B show horizontal cross-sections of the mandrel and deployable sail in both furled and deployed configurations.
Figure 3B:
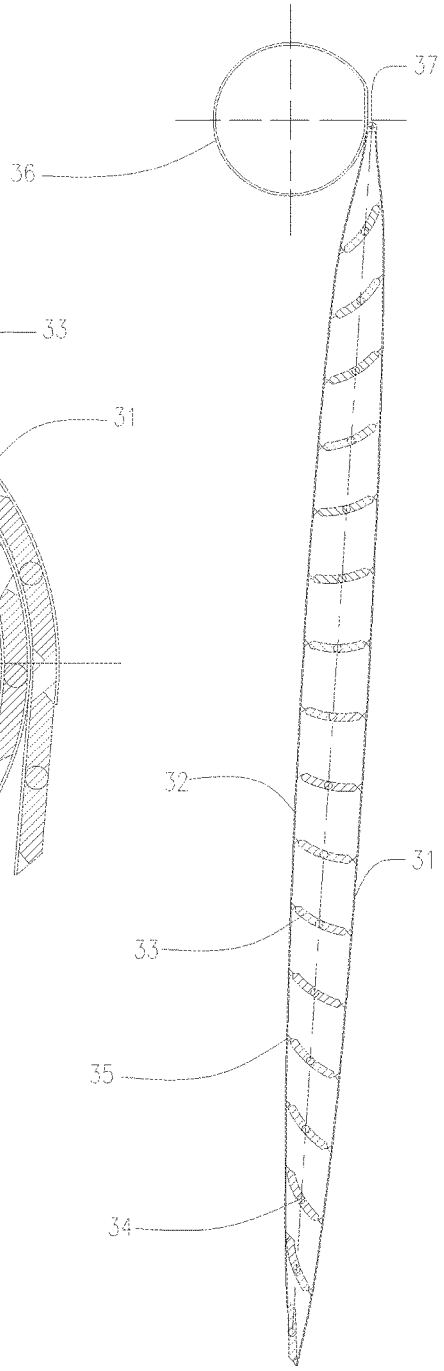

The heart of the embodiment is a deployable shell sail, as described in detail in the Cross-reference, and shown in FIGS. 3A and 3B. FIG. 3A illustrates an enlarged cross-section of the un-deployed, or furled, shell. It consists of an elastic outer panel 31 and a similar inner panel 32 connected by hinged 35 curved webs 33. Both panels are attached to an elongated hinged connection device 37 which is, in turn, connected to a cylindrical mandrel 36. Upon clockwise rotation of the mandrel, the sail is deployed (unfurled) as illustrated in FIG. 3B. Position of the deployed sail is controlled by guide devices attached to the web ends whose location 34 is shown on the cross-section. In FIG. 3B, the guide devices are constrained within linear tracks (not shown) located along the centerline of the deployed sail.

Figure 4A:
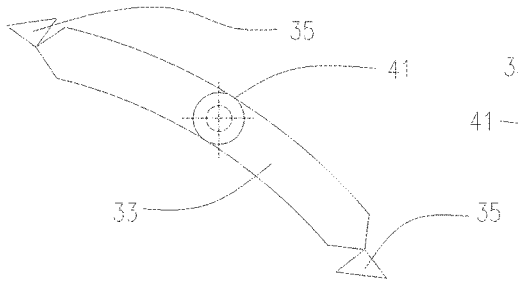
FIGS. 4A and 4B illustrate end and side views of a typical web element, and attached hinges and web support-guide.
Figure 4B:
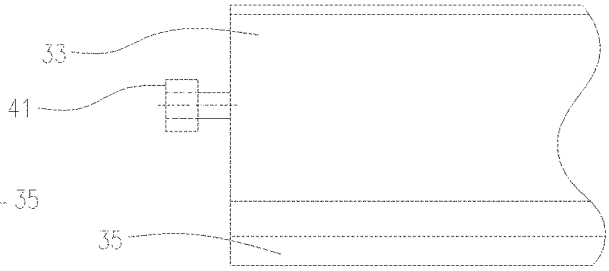

FIGS. 4A and 4B show enlarged views of a typical web 33, one end of which is illustrated. Also shown are typical integral hinges 35 and web support and guide 41 which is bedded within the web. It is noted that, in this depiction, webs and integral hinges would be constructed of core material and fiber reinforced polymer (FRP) where the rotation region of the hinge remains flexible.

Figure 5A:
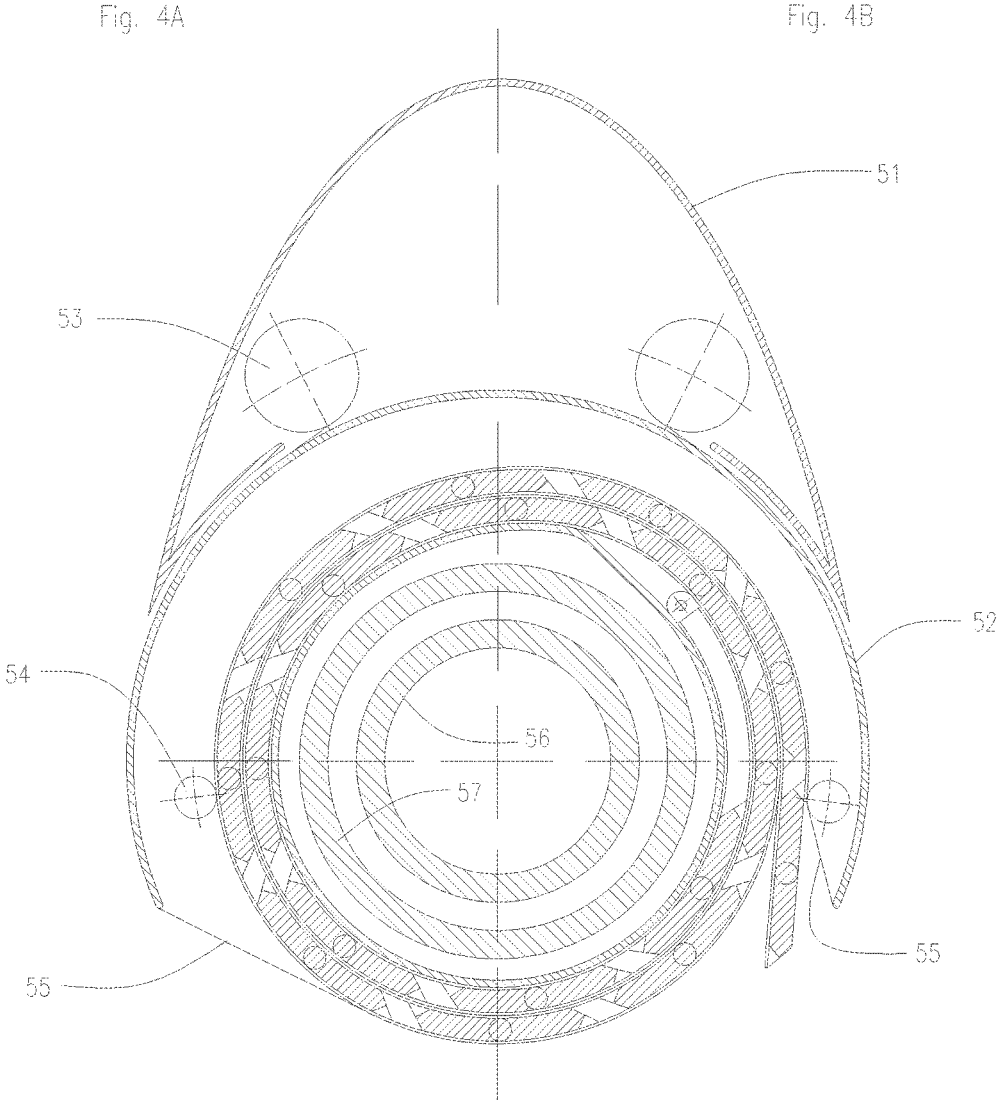
FIGS. 5A through 5D are cross-sectional views of the mast and mast-sail assemblies for the furled, port tack, feathered and starboard tack configurations, respectively.

A cross-section of the entire furled mast-sail assembly is depicted in FIG. 5A. In addition to the stowed sail, the central region contains the mast 56 and the control and guide connection tube 57. The mast 56 is not directly connected to the sail assembly, but is firmly anchored to the vessel and helps stabilize the sail assembly. Also shown is the outer aerodynamic fairing 51 and inner fairing 52. Attached to and contained within the outer fairing are two flexible aerodynamic sheet take-up and storage spools 53. The spring-loaded spools release the flexible sheets 55 as the sail is deployed and store the sheets as the sail is furled. Contained within the inner fairing are sail compression rollers 54. The roller suspensions, which are attached to the inner fairing, are pre-sprung so as to provide a radial inward force to the furled sail, thus maintaining a compact furled configuration.

Figure 5B:
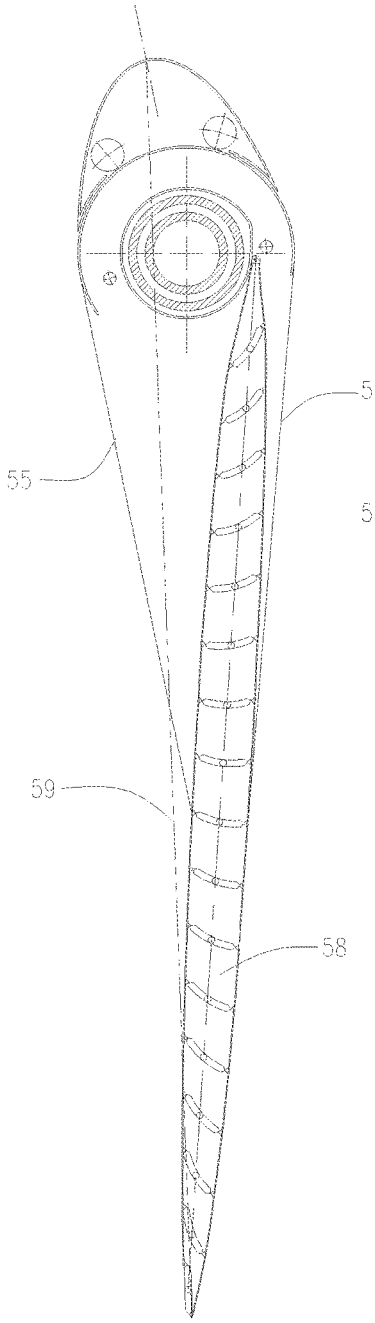
Figure 5C:
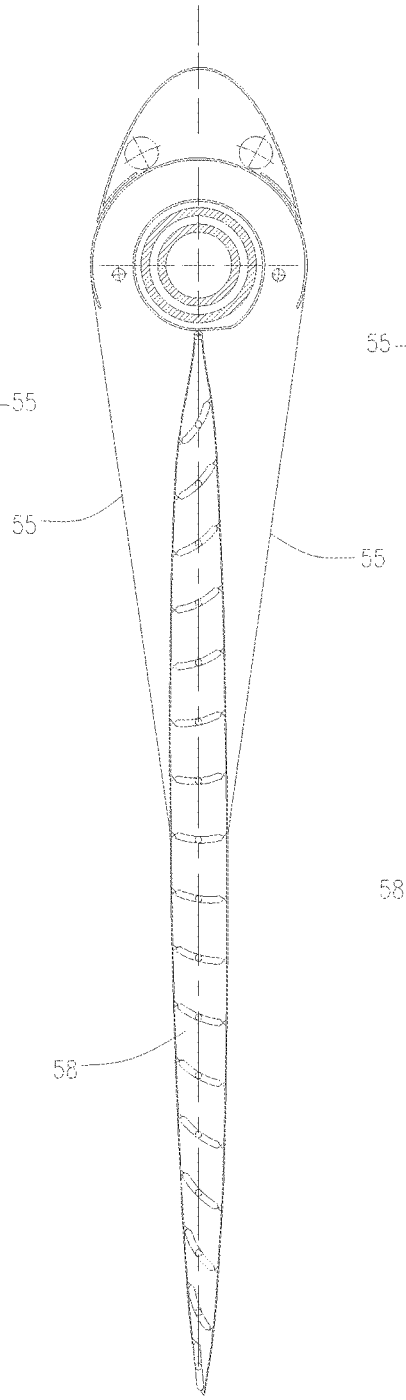
Figure 5D:
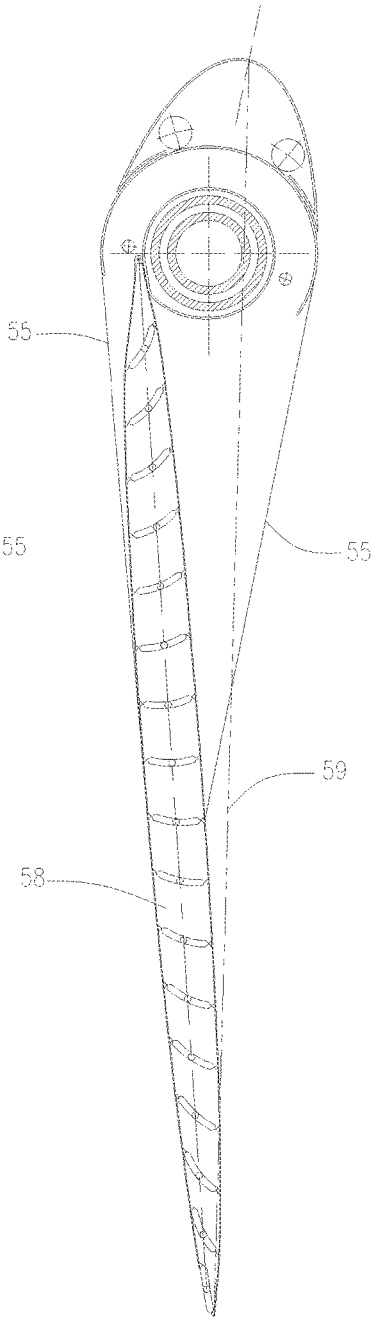

FIGS. 5B through 5D illustrate cross-sections of the mast-sail assembly for three deployed sail configurations: port tack, feathered and starboard tack, respectively. It is seen that both flexible aerodynamic sheets 55 are attached to the sail panels approximately half-way along the deployed sail. Also, it is seen that the aerodynamic fairings, 51 and 52, rotate together about the mast centerline to positions which depend on the deployed configuration. For aerodynamic parameter (lift and drag coefficients as functions of relative wind angle measured from the airfoil chord) definitions, the airfoil chord 59 is shown for both port and starboard tack configurations.

Upon deployment of the sail 58 and rotation of the fairings 51 and 52, the embodiment is in the port tack configuration, FIG. 5B. From this configuration, rotation of the mandrel 36 and attached sail 58 results in the feathered configuration, FIG. 5C. Further rotation of the mandrel and attached sail results in the starboard tack configuration, FIG. 5D. Also, the fairings 51 and 52 are rotated during these embodiment configuration changes.

Figure 6A:
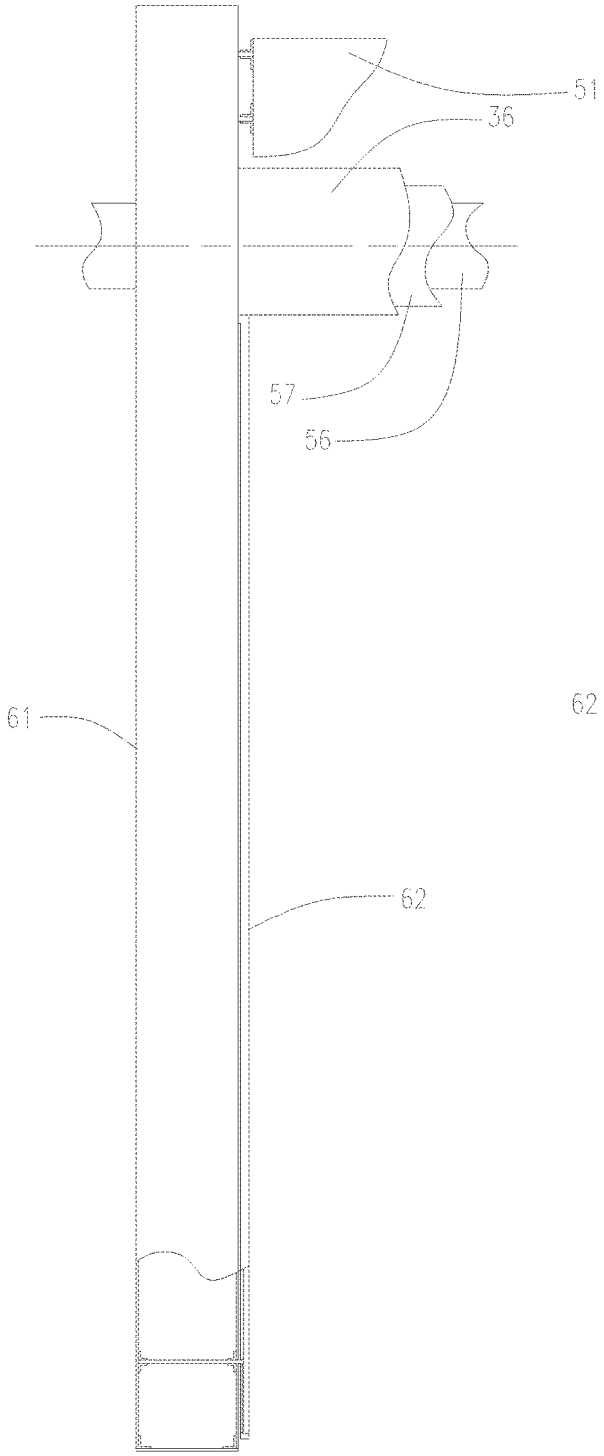

First Embodiment, Control and Guide Assembly—FIGS. 6A though 7B

Figure 6B:
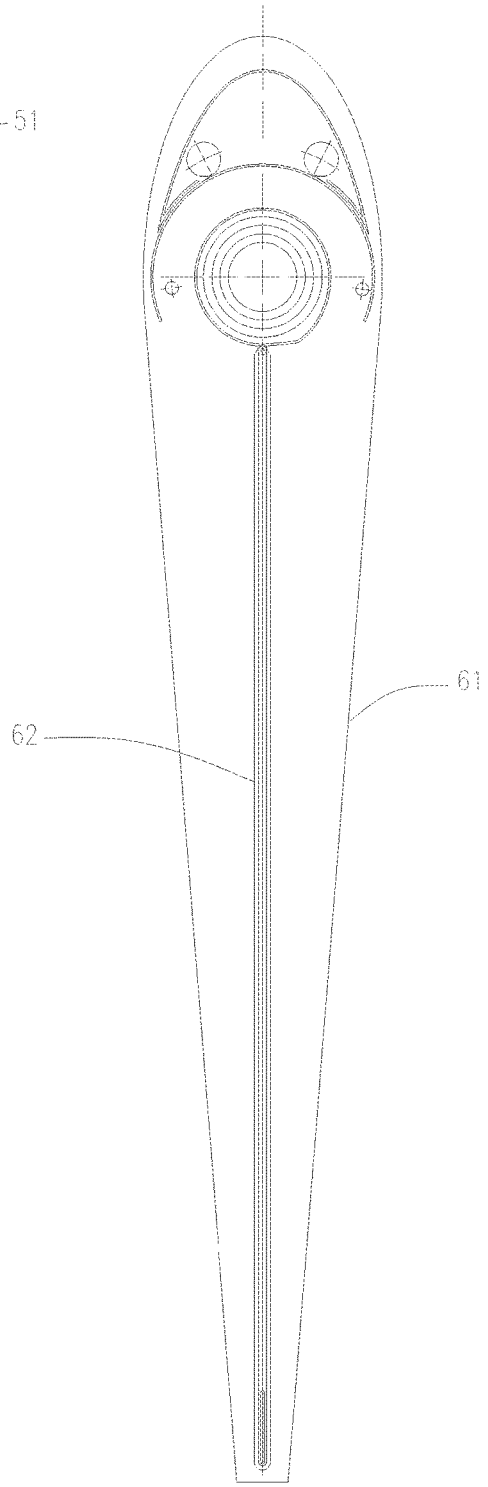

Side and plan views of the overall control and guide assembly are shown in FIGS. 6A and 6B. The purpose of this assembly is provision of means for rotation of the deployable sail mandrel and the aerodynamic fairing system. In addition, the assembly provides a secure base for the sail support and guide track. Only one assembly is described since the upper and lower assemblies are mirror images. For clarity, the deployable sail 58 and internal structural bracing of the assembly body 61 are not shown. Included in the plan view are the fairings 51 and 52. A portion of fairing 51 is also shown in FIG. 6A. The sail support and guide track 62 is shown in the feathered configuration position, FIG. 6B.

Figure 6C:
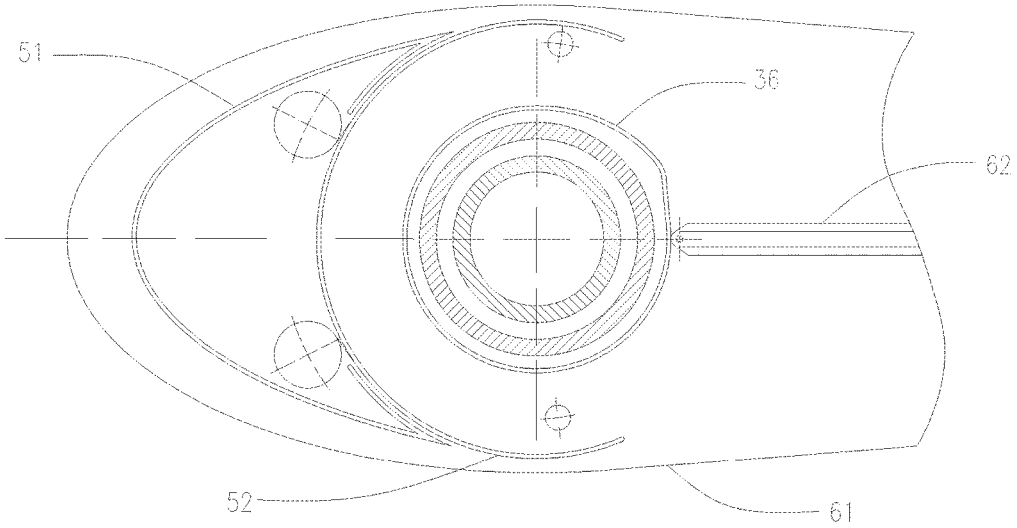
Figure 6D:
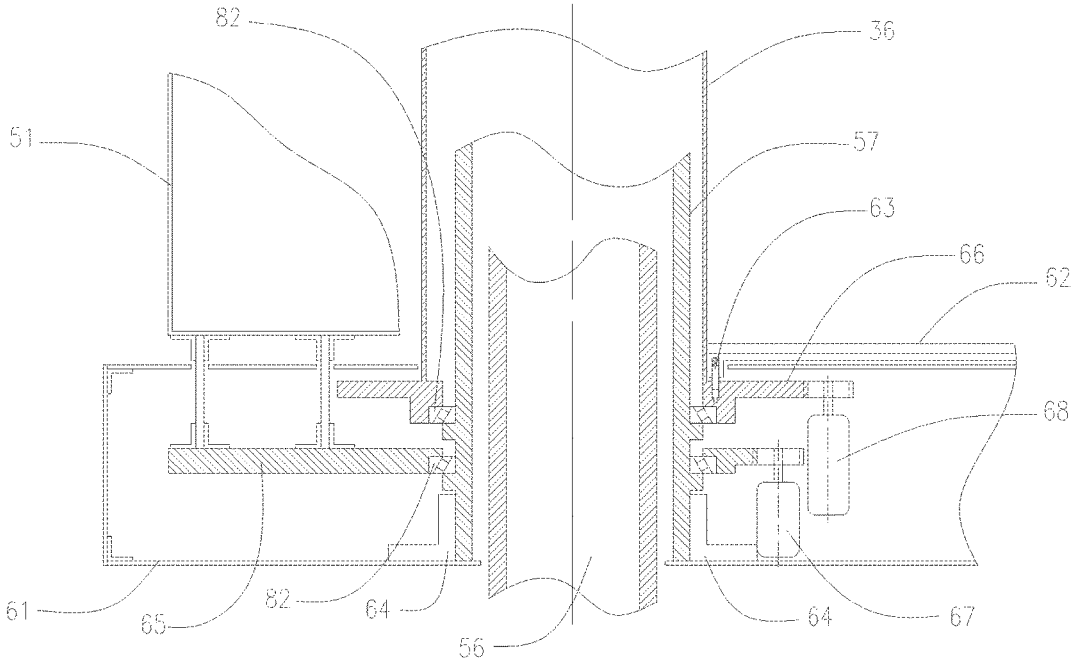

FIGS. 6C and 6D are a detailed plan and cross-section of the mast end of the control and guide assembly. The luff-end of the support and guide track 62 is attached, by means of pin 63 to the cam plate 66 which is, in turn, attached to and forms the base of mandrel 36. The guide and control assembly connection tube 57 is attached to both upper and lower guide and control assemblies by means of the sail module connection flange 64 thus assuring that both assemblies synchronously rotate about the mast centerline. Both of the fairings 51, 52 are connected to the fairing support ring 65. This ring and the cam plate 66 are supported by the assembly connection tube 57 by means of tapered roller bearings 82. The circular cam plate is rotated by means of a motor 68. An additional motor 67 rotates the fairing support ring 65 which is not circular due to the limited rotary motion of the fairings. Both of the motors may be powered by either electric or hydraulic means.

Figure 6E:
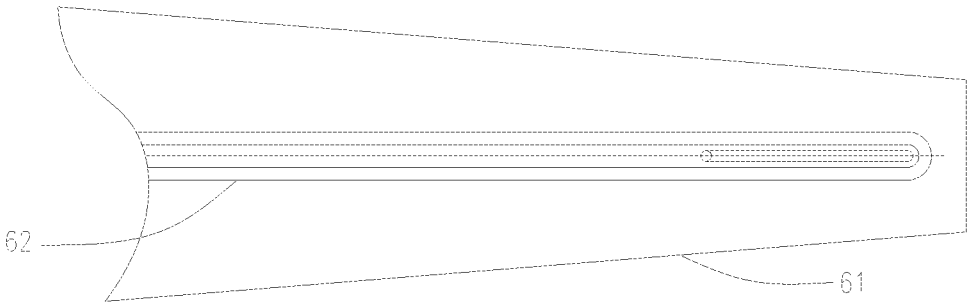
Figure 6F:
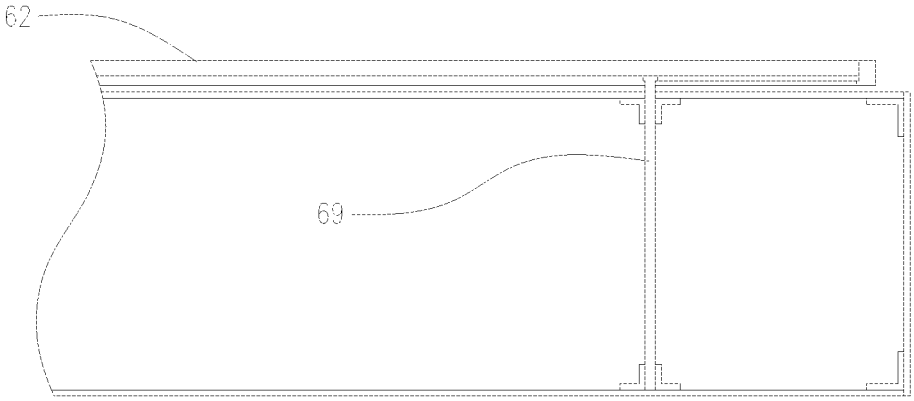

FIGS. 6E and 6F are plan and cross-section details of the control and guide assembly leech end. Shown are the support track 62 end and track rotation center pin 69. In addition to centering track rotation, pin 69 captures the track, in a slot, so as to allow longitudinal track movement with respect to the assembly body 61.

Figure 6G:
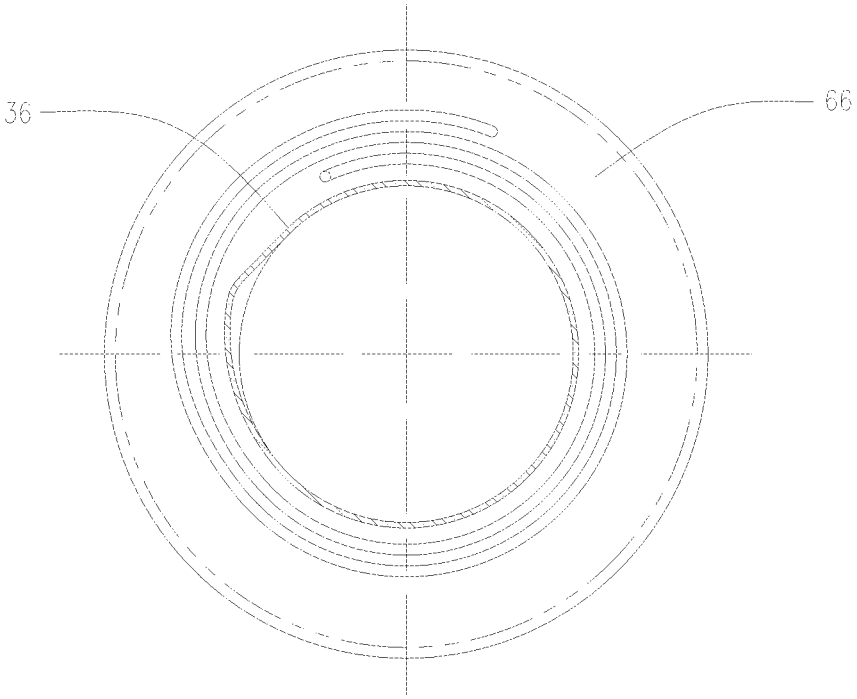

FIG. 6G is a detail plan view of the cam plate 66 and mandrel 36 cross-section. The track-cam connection pin 63 rides in the cam plate groove. In the fully furled configuration, the connecting pin is located at the outermost groove end. During sail deployment, the pin follows the groove inward until it reaches the innermost groove end at full deployment. The pin 63 is spring loaded so that upon reaching the inner groove end, it extends into the circular depression at the groove end, thus translationally locking the track end to the cam plate. This allows the track end and mandrel to synchronize during sail embodiment tacking configuration changes. At the beginning of the furling configuration change, the pin 63 is forced out of the locking depression by mechanical or hydraulic means, thus allowing the pin to follow the cam plate 66 groove during mandrel rotation for sail retraction.

FIGS. 7A and 7B are cross-section and plan views of the mast top alignment bearing 72 and cover 71. This small assembly is used for stand-alone single embodiment module applications, such as those illustrated in FIGS. 2A through 2D where the cover flange is attached to the upper control and guide assembly 13.

First Embodiment, Sail Module Support and Rotation Assembly—FIGS. 8A and 8B

FIGS. 8A and 8B are plan and cross-section views of the sail module support and rotation assembly. The purpose of this assembly is for secure fixation of the mast base to the vessel and for the means of rotation of the entire sail system. Vertical support of the sail system is provided by the sail module support flange 81. The vertical support force is, in turn, transmitted through bearings 82 to the outer support tube 83, and thus, to the vessel. Horizontal force transmitted from the sail to the vessel is resisted by composite bending of the mast 56, support flange 81 and outer support tube 83, as well as by shear resistance of these components. A means of rotational force applied to the support flange is provided by the sail module rotation torque motor 84.

First Embodiment—Construction and Operation

Construction of this sail system is straightforward, even for the deployable sail portion of the mast-sail assembly. As described in the Cross-reference, construction of this sub-assembly is easily accomplished by first attaching the outer and inner panels 31, 32 to a construction mandrel of similar dimensions to that of the embodiment mandrel 36. The web-hinge-support panels (33, 35, 41) are preassembled. For each web, the hinges are attached to both of the panels after which the construction mandrel is rotated and the process repeated for all webs. Thus, proper spacing of the hinge-to-panel connections is automatically ensured.

A variety of construction materials is possible. Due to the versatility and high strength to weight ratio of fiber reinforced polymers (FRPs), these materials are well-suited for the deployable sail design. High strength to weight metals, such as heat-treated aluminum alloy, are suitable for the mast 56 and assembly covering skins. For those portions of the embodiment requiring high strength and durability, such as the sail module module support and rotation assembly (81 and 83) and the load bearing portions of the control and guide assembly (65 and 66), a high strength steel alloy is appropriate.

Operational ease and efficiency are important design requirements of this embodiment. FIGS. 2A through 2D illustrate typical operational configurations. A transition from furled, FIG. 2A, to starboard tack, FIG. 2B, configurations requires operation of only motors 67 (fairing rotation) and 68 (mandrel rotation). Motor 84 is then utilized for rotational trimming the embodiment to obtain maximum driving force. Transition from the starboard tack to port tack, FIG. 2D, configurations is accomplished while passing through the feathered configuration, FIG. 2C. Only small movements of mandrel and fairing are required while the embodiment rotational position is adjusted to account for the vessel course change. All of these operations may be easily accomplished by a single human operator. Alternatively, using input from wind and course sensors, operation of the embodiment configuration change motors may be automated utilizing programmed computer control. Experimentally determined module lift and drag coefficients, as functions of relative wind angle of attack, would be utilized in computer automation.

Additional Embodiments—FIGS. 9A through 12

Among many possible, three additional, embodiments are briefly described. These embodiments illustrate usage of the first embodiment module for creation of multi-module applications. The additional embodiments are configured for actual vessel usage. Thus, dimensions of a typical first embodiment module are taken to be: total height (excluding mast step and rotation assembly)—10 m, total maximum horizontal width—4 m. Therefore, for embodiments requiring two or more stacked modules, additional lateral support, in addition to inherent module strength, may be required. This is accomplished with conventional standing rigging which is augmented with a mast head assembly as conceptually illustrated in FIGS. 9A through 9C.

Additional Embodiments, Mast Head Assembly—FIGS. 9A through 9C

For standing rigging attachment to stacked modules, a mast-head rigging attachment assembly may be required which is attached to the top of the uppermost sail module. Overall exterior views of the conceptual mast head assembly 91 are illustrated in FIG. 9A. Fittings are provided for: forestay 92, shroud lines 93 and backstay 94 fittings. FIGS. 9B and 9C are cross-section details of the mast attachment region. The assembly is securely attached to the mast 56 at its top end, thus constraining the assembly alignment to that of the vessel. The preponderance of vertical rigging loads are carried by the mast directly to the vessel through the mast step assembly. Some vertical load and horizontal axis bending moments induced by the rigging are carried by bearings 82 and flange 95 which is attached to the upper surface of the uppermost sail module. Bearings 72 also carry some of the bending moment induced horizontal force as well as providing alignment with the mast.

Additional Embodiments, High Performance Yacht—FIG. 10

Non-commercial applications of the first embodiment sail system include recreational and competitive vessels. FIG. 10 illustrates a high performance yacht embodiment where two basic sail modules are vertically combined on a single mast, including mast step 15 and head 91 assemblies, with full standing rigging support. From the basic module dimensions assumed, this embodiment sail area is nominally 80 square m with overall aspect ratio 5.0. Also, conventional sails, such as a jib and spinnaker could be used in the forward part of the yacht. The resulting vessel would be highly efficient, and when used in regatta environments, very competitive.

Additional Embodiments, Commercial Applications

Due to the exceptional efficiency and operability of the first embodiment sail system module, adaptations of this sail embodiment to commercial uses is both profitable and extremely environmentally friendly. Crew numbers required for both maintenance and operation of a large number of sail modules is small. Both efficiency and operability of the sail modules is enhanced through computer controlled automation of the module configuration modification motors. Also, prevailing wind patterns would be included in course planning so as to minimize use of conventional fuels while maintaining acceptable passage times.

Additional Embodiments, Purpose-Built Sailing Vessel—FIG. 11

In the 19th and early 20th centuries, the fabric-sailed multi-mast schooner was one of the most popular ship configurations. However, sail handling required a sizable crew which, together with relatively inefficient sails, contributed to poorer economics when compared with fossil fuel powered vessels. However, very efficient sail design and automated operations results in much greater cost-effectiveness which, in turn, could be realized in modern commercial sailing vessels.

A conceptual purpose-built sailing vessel is illustrated in FIG. 11 where thirteen basic sail modules are combined to form a five-mast schooner (three masts with three modules each and two masts with two modules each) having a total sail area of 520 sq m (based on nominal module dimensions, 4 m×10 m). This vessel could be effectively utilized for coastal cargo transport or fishing operations. In addition, "wind-jammer" passenger cruises are becoming increasingly popular. This type of vessel would be perfectly suited for medium capacity passenger cruises.

Additional Embodiments, Sail-augmented Commercial Transport Vessel—FIG. 12

Hybrid sail—fossil fuel powered commercial vessels are feasible where a conventional propulsive system is augmented with wind power. This system would be effective for relatively low vessel speed operations in generally favorable prevailing wind regions. The key for realizing sail power propulsive augmentation is computerized control of the sail modules based on experimentally derived lift-drag data for expected wind speeds and sail module configurations.

FIG. 12 illustrates a conceptual sail module system utilized on a medium capacity commercial bulk liquid transport vessel. An important factor is the ability to easily and inexpensively modify existing conventionally powered vessels with sail module based structures. The figure shows how groups of six sail modules may be assembled onto bridge-like structures which are attached to the vessel gunwales.

Additional Embodiments—Advantages

A number of advantages are evident in the embodiments described above:

(a) Inherent modularity of the first embodiment sail system allows great flexibility when building additional embodiments utilizing module combinations.

(b) Recreational usage embodiments enable safe and easily manageable, yet fast and efficient yachting vessels.

(c) Embodiments targeting competition usage have the advantages of high speeds due to module efficiency and rapid configuration changes due to ease of module operation.

(d) Commercial usage embodiments enable cost-effective utilization of sail power, due to efficiency and operability, for vessels whose primary motive energy source is wind and for sail power augmentation where the primary energy source is fossil fuels.

CONCLUSION, RAMIFICATIONS AND SCOPE

A deployable reversible camber sail system has been disclosed. This system is relatively simple in concept and construction, yet is highly efficient and easily operable with the following capabilities:

- it has a compact furled configuration which is easily and quickly converted to the deployed configuration;
- in its deployed configuration, it has a very large stiffness to weight ratio which results in low weight, deformations and flutter;
- when deployed, it easily and quickly modified into the feathered, port tack, starboard tack and furled configurations;
- in its deployed configuration, it forms a highly efficient reversible camber airfoil;
- operation of the system is accomplished using servomotors which enables easy operability and the ability to automate operation; and
- due to the first embodiment's inherent modularity, many recreational, competitive and commercial additional embodiment designs are possible using combinations of the basic module.

Although the above discussion contains many specificities, these should not be construed as limiting the scope of the embodiments, but as merely providing illustrations of some of several embodiments. Thus the scope of the embodiments should be determined by the appended claims and their legal equivalents, rather than by the examples given.

I claim:

1. A deployable sail system, based on a deployable shell design, capable of sail stowage, sail deployment, sail camber reversibility, and sail trim rotation about a vertical axis, comprising:

a. a mast (56), substantially vertically oriented, firmly connected to a watercraft or land vehicle, and providing stability and strength to said sail system;

b. a first sail control and guide assembly (13) and a second sail control and guide assembly (14), being mirror images, each supported by and rotatable about said mast axis, and each comprising:
1. a sail support and guide track (62),
2. a cam plate (66),
3. a track-cam connection pin (63),
4. a cam plate torque motor (68),
whereby, upon application of energy to said cam plate torque motor, said cam plate rotates about said mast axis resulting in either i. if said track-cam connection pin is disengaged, deployment or stowage of said sail results, or ii. If said track-cam connection pin is engaged, rotation, about a vertical axis, of said sail support and guide track occurs resulting in said sail camber reversal;

c. a deployable sail (31-33, 35, 36, 41) contained between said sail control and guide assemblies, comprising:
1. an outer panel (31),
2. an inner panel (32),
3. a plurality of elongated web elements (33),
4. a plurality of web-to-panel hinges (35),
5. a mandrel (36),
6. a plurality of web support and guides (41),
whereby, said mandrel is contiguous with said cam plates contained in said control and guide assemblies, and is connected, in a hinged manner, with said outer and inner panels which are, in turn, connected to each other by said web elements by said web-to-panel hinges, where said web support and guides, which are contiguous with said elongated web elements, are entrained by said sail support and guide tracks;

d. a control and guide connection tube (57), which contains and is coaxial with said mast, whose purpose is to connect with and ensure simultaneous rotation of said control and guide assemblies;

e. a sail module support and rotation assembly (15), located at the base of said mast and affixed to said watercraft or said land vehicle, whose purpose is to provide vertical support and rotational control of said sail module, comprising:
1. a sail module support flange (81),
2. an outer support tube (83),
3. a sail module rotation torque motor (84);
whereby, application of energy to said cam plate torque motor causes said deployable sail to deploy, retract, or reverse camber, and application of energy to said sail module rotation torque motor causes said sail module to rotate as a rigid body about the axis of said mast so as to trim said sail module with respect to the relative wind direction.

2. The deployable sail system of claim 1, wherein a fairing assembly, comprising:
a. a fairing rotation torque motor (67),
b. a fairing support ring (65),
c. an inner fairing (52),
d. an outer aerodynamic fairing (51),
e. two sail compression rollers (54),
f. two flexible fairing sheets (55),
g. two fairing sheet take-up rolls (53),
h. a tapered roller bearing (82),
may be incorporated into said sail module so that aerodynamic efficiency of said sail module is enhanced.

3. The deployable sail system of claim 2, wherein said fairing rotation torque motor may be actuated by means of electric or hydraulic energy.

4. The deployable sail system of claim 1, wherein, if said sail module or said sail module combination is employed without use of standing rigging support, a mast top cover (71) and mast alignment ball bearing (72) are affixed to the upper surface of the uppermost said sail control and guide assembly so as to provide weather tightness, alignment, and lateral support to said sail module or said sail module combination.

5. The deployable sail system of claim 1, wherein said outer panel and said inner panel may be fabricated of either metallic or fiber reinforced polymer materials.

6. The deployable sail system of claim 1, wherein said web elements and said web-to-panel hinges may be fabricated integrally of metallic, or core material and fiber reinforced polymers.

7. The deployable sail system of claim 1, wherein tapered roller bearings (82) may be included in said control and guidance assemblies and said sail module support and rotation assembly so as to reduce friction and enhance operability of said sail module.

8. The deployable sail system of claim 1, wherein a mast alignment ball bearing (72) may be included in said sail module support and rotation assembly so as to reduce friction and enhance operability of said sail module.

9. The deployable sail system of claim 1, wherein said cam plate torque motor and said sail module rotation torque motor may be actuated by means of electric or hydraulic energy.

* * * * *